United States Patent [19]

Morgan et al.

[11] Patent Number: 4,524,343

[45] Date of Patent: Jun. 18, 1985

[54] SELF-REGULATED ACTUATOR

[75] Inventors: Robert K. Morgan, Pleasant Hill; John R. Yaeger, Sunnyvale, both of Calif.

[73] Assignee: Raychem Corporation, Menlo Park, Calif.

[21] Appl. No.: 570,464

[22] Filed: Jan. 13, 1984

[51] Int. Cl.[3] ..... H01H 61/06

[52] U.S. Cl. ..... 337/140; 60/527

[58] Field of Search ..... 337/140; 60/527

[56] References Cited

U.S. PATENT DOCUMENTS 3,731,247 5/1973 Levinn ..... 337/140

*Primary Examiner*—Harold Broome

*Attorney, Agent, or Firm*—James W. Peterson; Ira D. Blecker; Herbert G. Burkard

[57] ABSTRACT

A self-regulated actuator is disclosed having a shape-memory element which is heated preferably by passing electrical current therethrough and having a reset mechanism including a circuit-breaking mechanism. The shape-memory element provides the force to retract the actuator when heated. The reset mechanism utilizes a spring-biased latch plunger that resets the actuator as soon as it has retracted a specific distance. The reset mechanism also acts as a circuit-breaking mechanism to electrically interrupt current heating the shape-memory element. The reset mechanism provides near-instant reset time and overcomes the longer wait period otherwise associated with the natural cooling of the shape-memory element. The reset mechanism prevents overheating of the shape-memory element and precludes the necessity for additional hardware to interrupt the circuit after actuation is completed. Also discussed is a self-protection means that protects the shape-memory element from deliberate and accidental overloads and to accommodate the extra motion required for high-cycle design life.

12 Claims, 5 Drawing Figures

SELF-REGULATED ACTUATOR

BACKGROUND OF THE INVENTION

The field of this invention shape-memory-effect actuators and in particular those usages of shape-memory alloy as they apply to making linear electro-mechanical actuators.

Shape-memory-effect (SME) alloys have been known and available for many years. Principal applications have used the nickel-titanium SME alloys in high-performance products such as aircraft hydraulic couplings. Because of their dramatic strength and response to temperature, SME alloys have continuously been proposed as alternatives to motors, solenoids, bimetallic or wax-type actuators. Although not a panacea, a SME approach to electro-mechanical actuation may offer advantages which conventional approaches would find difficult or impossible. For example, large amounts of recoverable strain available from SME alloys offer work densities up to ten times higher than conventional approaches. High electrical resistivity (similar to nichrome) permits direct electrical actuation without extra parts and with efficient use of available energy. Furthermore, large available material strains permit extremely long strokes, constant force during the stroke, and high starting force.

SME alloys have been used for actuator-type devices previously. Generally, the material is a nickel-titanium alloy called Nitinol® or Tinel® although copper-based alloys have been used in many similar applications. Applicant's copending U.S. Pat. Application Ser. No. 474,931, filed March 14, 1983, which is incorporated herein by reference, discloses various actuators employing a shape-memory alloy component. The instant invention is an improvement over that disclosed in applicants' above-mentioned application in that the instant actuator provides a reset mechanism that releases the actuator after it has retracted a specific distance and also interrupts the electrical circuit when the actuator is reset. The instant actuator is also provided with a self-protection means to protect the SME element from accidental and deliberate overloads, and to accommodate the extra motion required for high-cycle design life. An overload occurs during a jam of the actuator or when a load in excess of a predetermined amount designed into the actuator occurs.

SUMMARY OF THE INVENTION

The purpose of this invention is to provide a self-regulated actuator that is resettable, that when electrically heated will self-interrupt the electric current after actuating and reaching the end of its stroke, and which protects the actuator or any mechanism to which the actuator is attached from damage by the actuator in the event of a jam or other mishap that tries to prevent the mechanism from moving.

To accomplish this purpose the instant actuator provides a self-regulated actuator having a shape-memory element that is capable of dimensional recovery when transformed from a martensitic state to an austenitic state and, preferably, a plunger, latch means and spring means operatively connected to the shape-memory element to generally release the action of the shape-memory element after it has retracted a specific distance and to interrupt electrical current which is heating the shape-memory element. Additionally, the invention provides a self-protection means which may mechanically and electrically protect the shape-memory element when the element encounters an overload situation.

One aspect of this invention resides in an actuator comprising a shape-memory element capable of being longitudinally expanded when in its martensitic state and capable of being longitudinally recovered when in its austenitic state, said element capable of dimensional recovery when heated from said martensitic state to said austenitic state, said element having a first end and a second end along the longitudinal axis thereof; a plunger located at the first end of said element; a latch means connecting said plunger to said first end of said element when said element is longitudinally expanded, said latch means releasing said plunger at a predetermined position as said element recovers; spring means connected to said plunger biasing said plunger away from said element, said spring means capable of moving said plunger away from said element when the plunger is released by the latch means; and element return means biasing said first and second ends away from each other and capable of expanding said element when said element is in its martensitic state.

Another aspect of this invention resides in an actuator comprising a shape-memory element capable of being longitudinally expanded when in its martensitic state and capable of being longitudinally recovered when in its austenitic state, said element capable of dimensional recovery when heated from said martensitic state to said austenitic state, said element having a first end and a second end along the longitudinal axis thereof; a contact plate adjacent the second end of said element; and a self-protection means connected to said second end normally biasing said second end into contact with said contact plate, the self-protection means releasing contact between said second end and said contact plate when said element encounters a jam or excessive load overcoming the biasing to allow movement of the element without expanding the element.

DESCRIPTION OF THE PREFERRED EMBODIMENT

Figure 1:
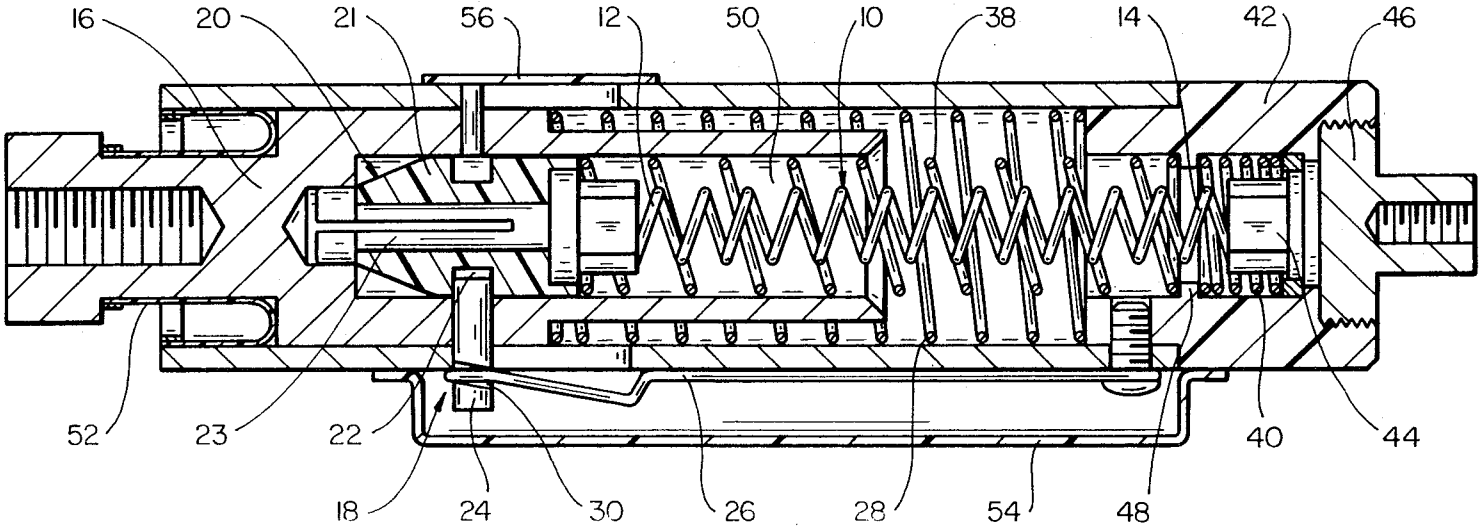
FIG. 1 is a cross-sectional view of the actuator of the instant invention.

With reference to FIG. 1, a self-regulated actuator is illustrated prior to actuation. The actuator includes a shape-memory element 10 having first end 12 and second end 14. Element 10 is capable of being longitudinally expanded when in its martensitic state. This is as shown in FIG. 1. Element 10 is capable of being longitudinally recovered when in its austenitic state, as will be more clearly seen with respect to FIGS. 3–5. Specifically, the element is capable of dimensional recovery when the alloy of the element is heated and goes from a martensitic state to an austenitic state.

Element 10 is formed from shape-memory alloy. Shape-memory alloys are disclosed in U.S. Pat. No. 3,012,882, U.S. Pat. No. 3,174,851, and Belgian Patent No. 703,649, the disclosures of which are incorporated by reference herein. As made clear in these patents, these alloys undergo a reversible transformation between austenitic state and martensitic states at certain temperatures. When they are deformed while in the martensitic state, they will retain this deformation while retained at that temperature, but will revert to their original configuration when they are heated to a temperature at which they transform to their austenitic state. This ability to recover upon warming has been utilized in commonly-assigned U.S. Pat. Nos. 4,035,007 and 4,198,081, which are also incorporated by reference herein. The temperatures at which these transitions occur are affected by the nature of the alloy. The shape-memory alloy from which the shape-memory element 10 may be fabricated is preferably a titanium/nickel-based alloy such as that disclosed in copending and commonly-assigned U.S. Patent Application Ser. No. 355,274, filed Mar. 5, 1982, now abandoned, which is incorporated herein by reference.

Shape-memory element 10 is connected at its first end 12 to the reset mechanism. The reset mechanism includes plunger 16 and the latch means shown generally at 18. Latch means 18 includes an insert shown generally at 20 having a peripheral detent 22. Latch means 18 further includes pin 24 and cam member 26. The reset mechanism further includes spring means 28 which biases the plunger 16 away from second end 14 of the element.

Plunger 16 is located at the first end 12 of element 10. Plunger 16 contains an opening therein in which is located complementary-shaped insert 20. Insert 20 is connected mechanically and electrically to first end 12 of element 10. The outer portion 21 of insert 20 is electrically non-conductive and the core 23 of insert 20 is conductive. Insert 20 is provided with a peripheral detent 22 which accommodates pin 24. It can be seen in FIG. 1 that pin 24, when engaged within detent 22, will electrically and mechanically connect the plunger 16 to first end 12 of element 10.

Pin 24 is provided at the extreme end thereof with a cam engagement portion 30 created by an opening through pin 24. The cam engagement portion 30 rides on cam member 26 which is shown to be an irregularly-shaped piece of wire mounted on the periphery of the actuator. It can be seen that as the pin 24 is drawn to the right as shown in FIG. 1 by the recovery of element 10, pin 24 will ride up the surface of cam member 26 until the pin 24 moves outside the detent 22, releasing the insert 20 with respect to the plunger 16. This relationship will be described further with respect to FIGS. 3 and 4.

Figure 2:
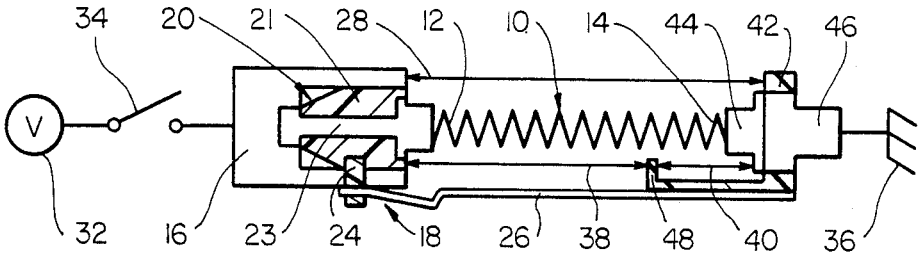
FIG. 2 is a partially schematic cross-sectional view similar to FIG. 1 showing the actuator before actuation.

Latch means 18 therefore connects plunger 16 to first end 12 of element 10 when the element 10 is longitudinally expanded as can be seen in FIGS. 1 and 2. Latch means 18 releases said plunger 16 at a predetermined position corresponding to the position shown in FIG. 3 as element 10 longitudinally recovers to its smaller dimension. At the point where pin 24 of latch means 18 disengages detent 22, spring means 28 biases plunger 16 away from the element 10. When plunger 16 is biased away from insert 20, current is interrupted, thereby preventing further unnecessary and excessive heating of element 10, precluding possible damage to element 10. Without this feature, some other separate means of interrupting or disconnecting the current would have to be included to prevent damage to element 10 via overheating. Spring means 28 is shown symbolically in FIGS. 2–5 where it can be seen in FIG. 4 that spring means 28 will move plunger 16 away from second end 14 when released by the latch means 18.

It should be noted that spring means 28 need not be located between plunger 16 and second end 14 of element 10. It is within the scope of the invention to locate a spring means (not shown) outboard of the plunger 16 in order to bias plunger 16 as discussed above.

Figure 3:
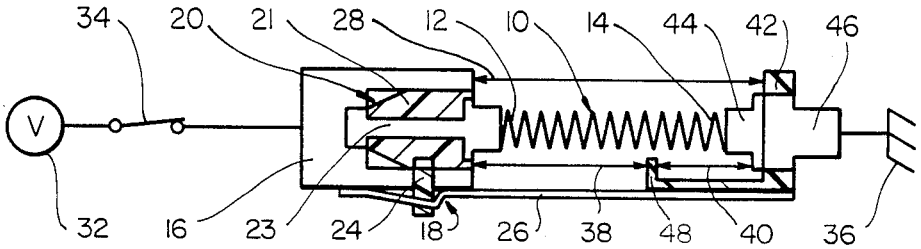
FIG. 3 is the same as FIG. 2 but shows the actuator shortly after actuation.
Figure 4:
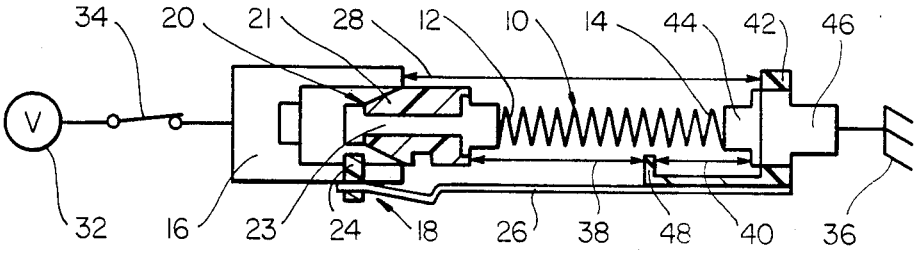
FIG. 4 is the same as FIG. 3 after the reset mechanism has functioned to reset and act as a circuit-breaking mechanism.

Shape-memory element 10 is preferably heated by passing electrical current through element 10. This is shown symbolically in FIGS. 2–5 by the provision of current generator 32, switch 34 and ground 36. The electric current is sufficiently large to heat the shape-memory element 10 above its transformation temperature, thus recovering (shrinking) it in length toward its recovered, austenitic state, thereby exerting a force on the plunger 16. It can be seen by a comparison of FIGS. 2 and 3 that the actuator of the instant invention may be connected to an external mechanism and upon actuation by introduction of the electric current by a switch 34 the actuator will go from an extended position as shown by FIG. 2 to a retracted position as shown by FIG. 3, and in self-regulated fashion will return to the elongated position shown in FIG. 4. Such an action is highly desirable when the actuator is used as a door-latch/release mechanism, where it is important that the actuator latch 16 reset to the elongated position in a near-instant amount of time. This self-releasing action circumvents the need for waiting a long time for the element 10 to thermally cool down and reset itself by natural environmental means.

Shape-memory element 10 may be thermally actuated, in which case latch means and spring means earlier discussed will act as the mechanical reset mechanism. When the shape-memory element is electrically heated, the reset mechanism also acts as a circuit-breaking mechanism, as can now be seen by a comparison of FIGS. 2–4. Specifically, it can be seen in FIG. 4 that movement of the plunger 16 away from second end 14 of element 10 will electrically disengage or interrupt the current flow between the plunger 16 and first end 12 of element 10. Element 10 will then cool from its dimensionally shortened, recovered austenitic state back toward its martensitic state until the insert 20 is reengaged with plunger 16. If switch 34 is still connected, the actuator would recycle.

Shape-memory element 10, when cooled, will return from its recovered austenitic state to its expanded, martensitic state with the help of element return means 38, shown to be a spring in FIG. 1 and shown symbolically in FIGS. 2–5. Element return means 38 is electrically non-conductive. This may be accomplished by coating a conductive spring with a non-conductive coating.

Figure 5:
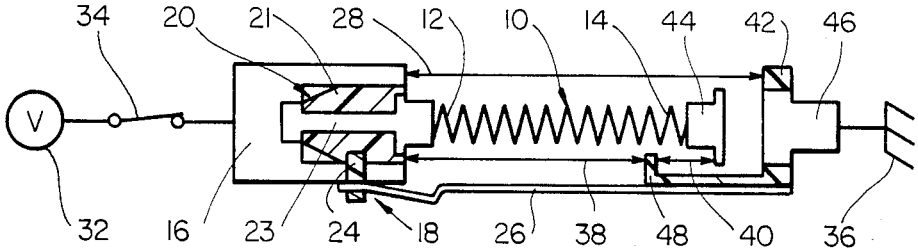
FIG. 5 is the same as FIG. 3 but wherein the actuator has been subjected to an unexpected restraint applied to the actuator.

Consider FIG. 5, where element 10 has been heated and is in its longitudinally-recovered austenitic state and wherein the plunger 16 has been deliberately or accidentally restrained. Such an event might occur when the mechanism to which the actuator is attached jams or otherwise becomes immovable. In this instance, it is desirable to prevent damage to the shape-memory element 10 and/or the mechanism to which the actuator is attached, in the event that the actuator is stronger than the mechanism. When this condition occurs, self-protection means 40 is interposed between a contact member and an extension 48 of the insulated end 42 of the actuator. Self-protection means 40 normally biases the second end 14 which has a contact member 44 toward contact plate 46. Contact plate 46 may have various geometric configurations. Self-protection means 40 is preferably a spring in compression, causing second contact member 44 to press against contact plate 46. With reference to FIG. 3, it can be seen that the current path during activation is through contact plate 46, contact member 44, shape-memory element 10, the core 23 of insert 20 through plunger 16.

It can be seen that self-protection means 40 thus acts much like the mechanical compensator means of applicants' earlier patent application and further provides an electrical circuitbreaking function. The force required to separate contact member 44 and contact plate 46 is determined by the force required to compress self-protection means 40. Self-protection means 40 is made stiffer for protection against heavy loads and weaker for lighter loads. it should be noted that said self-protection means will similarly act to extend the useful life of element 10 as described in applicants' earlier patent application. A person skilled in the art could easily perceive an adjustable load protection spring by arranging a mechanism to adjust (for example, with a screw thread) the position of extension 48 against which self-protection means 40 rests. It should be noted that self-protection means 40 may also be mounted outboard as long as it biases the contact member 44 as stated above.

Cooling means 50 is provided in contact with shape-memory element 10 to shorten the time required for element 10 to return from its austenitic state to its martensitic state. Cooling means is preferably shown as a cooling medium or liquid which may surround element 10. Cooling means 50 is maintained within the actuator by sealing members 52, 54 and 56 as can be seen in FIG. 1 during movement of the actuator. Sealing member 52 is a flexible membrane in the preferred embodiment. A preferred cooling means would be ethylene glycol which may be mixed with water.

From the foregoing detailed description, it is evident that there are a number of changes, adaptations and modifications of the present invention which will come within the province of those skilled in the art. However, it is intended that all such variations not departing from the spirit of the invention be considered as within the scope thereof as limited solely by the appended claims.

What is claimed is:

1. A self-regulated actuator comprising:

a shape-memory element capable of being longitudinally expanded when in its martensitic state and capable of being longitudinally recovered when in its austenitic state, said element capable of dimensional recovery when heated from said martensitic state to said austenitic state, said element having a first end and a second end along the longitudinal axis thereof;

a plunger located at the first end of said element;

a latch means connecting said plunger to said first end of said element when said element is longitudinally expanded, said latch means releasing said plunger at a predetermined position as said element recovers;

spring means connected to said plunger biasing said plunger away from said element, said spring means capable of moving said plunger away from said element when the plunger is released by the latch means; and element return means biasing said first and second ends away from each other and capable of expanding said element when said element is in its martensitic state.

2. An actuator as in claim 1 wherein the shape-memory element is capable of being heated by passing an electrical current between the first and second ends thereof.

3. An actuator as in claim 2 wherein the plunger is electrically in series with said element, said plunger conducting said current to said element when said latch means connects said plunger to said element and said plunger electrically interrupting current when the latch releases the plunger, the plunger and latch means acting as a currentbreaking mechanism.

4. An actuator as in claim 2 further including a contact plate adjacent the second end of said element and a self-protection means connected to said second end normally biasing said second end into mechanical and electrical contact with said contact plate, the self-protection means releasing contact between the second end and the contact plate and electrically interrupting the current when the element encounters a longitudinal jam or excessive load condition and overcomes the biasing to allow movement of the element without expanding the element.

5. An actuator as in claim 3 further including a contact plate adjacent the second end of said element and a self-protection means connected to said second end normally biasing said second end into mechanical and electrical contact with said contact plate, the self-protection means releasing contact between the second end and the contact plate and electrically interrupting the current when the element encounters a longitudinal jam or excessive load condition and overcomes the biasing to allow movement of the element without expanding the element.

6. An actuator as in claim 2 further including cooling means in contact with the shape-memory element to shorten the time required for the element to go from its austenitic state to its martensitic state.

7. An actuator as in claim 3 further including cooling means in contact with the shape-memory element to shorten the time required for the element to go from its austenitic state to its martensitic state.

8. An actuator as in claim 4 further including cooling means in contact with the shape-memory element to shorten the time required for the element to go from its austenitic state to its martensitic state.

9. An actuator as in claim 5 further including cooling means in contact with the shape-memory element to shorten the time required for the element to go from its austenitic state to its martensitic state.

10. A self-regulated actuator comprising:

a shape-memory element capable of being longitudinally expanded when in its martensitic state and capable of being longitudinally recovered when in its austenitic state, said element capable of dimensional recovery when heated from said martensitic state to said austenitic state, said element having a first end and a second end along the longitudinal axis thereof;

a contact plate adjacent the second end of said element; and a self-protection means connected only to said second end normally biasing said second end into contact with said contact plate, the self-protection means releasing contact between said second end and said contact plate when said element encounters an overload condition such as a longitudinal jam or excessive load and overcomes the biasing to allow movement of the element without expanding the element.

11. An actuator as in claim 10 wherein the shape-memory element is heated by passing electrical current between the first and second ends thereof and wherein the self-protecting means and the contact plate are normally electrically in series with said element, said self-protecting means electrically interrupting the current when said element encounters an overload condition.

12. An actuator as in claim 11 further including cooling means in contact with the shape-memory element to shorten the time required for the element to go from its austenitic state to its martensitic state.

* * * * *